US007089633B2

(12) United States Patent
Liu

(10) Patent No.: US 7,089,633 B2
(45) Date of Patent: Aug. 15, 2006

(54) SIDE RELEASE BUCKLE

(75) Inventor: Chun Chien Liu, Changhua Hsien (TW)

(73) Assignee: Kim Ging Hui Enterprise Co., Ltd., Changhua Hsien (TW)

( * ) Notice: Subject to any disclaimer, the term of this patent is extended or adjusted under 35 U.S.C. 154(b) by 76 days.

(21) Appl. No.: 10/942,681

(22) Filed: Sep. 15, 2004

(65) Prior Publication Data

US 2006/0053600 A1 Mar. 16, 2006

(51) Int. Cl.
*A44B 11/25* (2006.01)

(52) U.S. Cl. ..... 24/615; 24/616; 24/633; 24/625; D11/216

(58) Field of Classification Search ..... 24/615, 24/614, 625; D11/216; A44B 11/25
See application file for complete search history.

(56) References Cited

U.S. PATENT DOCUMENTS

| | | | | |
|---|---|---|---|---|
| 5,774,956 | A * | 7/1998 | French et al. | 24/625 |
| 6,263,548 | B1 * | 7/2001 | Ikeda | 24/625 |
| 6,311,374 | B1 * | 11/2001 | Anscher | 24/625 |
| 6,363,590 | B1 * | 4/2002 | Lan | 24/614 |
| 2002/0040514 | A1 * | 4/2002 | Uehara et al. | 24/614 |

* cited by examiner

*Primary Examiner*—Robert J. Sandy
*Assistant Examiner*—Marcus Menezes
(74) *Attorney, Agent, or Firm*—Pro-Techtor Int'l Services

(57) ABSTRACT

A side release buckle is disclosed to have a center lock formed of a hooked portion at the free end of the center bar of the male buckle member and a hook hole in the bottom wall of the female buckle member to reinforce the strength of the connection between the locking bars of the male buckle member and the respective side notches of the female buckle member. The locking bars each have a wedge block for lifting the free end of the center bar to unlock the center lock when the user squeezed the locking bars inwards to disengage the locking bars from the side notches of the female buckle member.

4 Claims, 4 Drawing Sheets

SIDE RELEASE BUCKLE

BACKGROUND OF THE INVENTION

1. Field of the Invention

The present invention relates to a buckle and more particularly, to a side release buckle.

2. Description of the Related Art

Belts and straps are intensively used to collars, harnesses, baby cradles, backpacks, safety helmets, slippers, life vests, cargoes, vehicle seats, etc. For joining belts or the ends of a belt, a buckle may be used. Various buckles have been disclosed and commercialized.

FIGS. 1 and 2 show a typical belt buckle. This design of belt buckle is called "side release buckle" because it is to be unlocked from the two opposite lateral sides. As illustrated, the side release buckle 50 is comprised of a male buckle member 51 and a female buckle member 52. The male buckle member 51 comprises two axially extended locking bars 53*a*,53*b* and a center bar 54 spaced between the locking bars 53*a*,53*b*. The female buckle member 52 comprises a receiving open chamber 55 for receiving the locking bars 53*a*,53*b* and the center bar 54, and two side notches 56*a*,56*b* respectively formed in the two opposite lateral sidewalls thereof for retaining the locking bars 53*a*,53*b*. When inserted the male buckle member 51 into the receiving open chamber 55 of the female buckle member 52, the locking bars 53*a*,53*b* are forced by their resilient material property into engagement with the side notches 56*a*,56*b* to lock the male buckle member 51 to the female buckle member 52. When the user squeezed the locking bars 53*b*,53*b* inwards with the fingers to disengage the locking bars 53*a*,53*b* from the side notches 56*a*,56*b*, the male buckle member 51 is unlocked from the female buckle member 52.

The male buckle member 51 and female buckle member 52 of the aforesaid side release buckle 50 are injection-molded from plastics. Because the side release buckle 50 is made of plastics, the tensile strength of the side release buckle 50 is not very high. In order to have the locking bars 53*a*,53*b* be easily disengaged from the side notches 56*a*,56*b*, the cross-sectional area of the locking bars 53*a*,53*b* must be limited. Due to a small cross-sectional area, the locking bars 53*a*,53*b* are the weakest part of the male buckle member 51. When the side release buckle 50 receives a pulling force surpassed the tensile strength of the locking bars 53*a*,53*b*, the locking bars 53*a*,53*b* will break.

As stated above, belts and straps may be used with a side release buckle in any of a variety of products. Some designs may have to receive a high pulling force, and some others may not. The side locking design of the aforesaid side release buckle is sufficient for most occasions of use. However, when the aforesaid side release buckle is used in a harness or collar for dog, the engagement between the locking bars of the male buckle member and the side notches of the female buckle member may be insufficient to support a sudden stretching force when the dog is frightened to run in a rash. In this case, the locking bars will break, and the frightened dog may be injured or may injure some other people.

Increasing the cross sectional area of each locking bar without changing material tensile strength will relatively improve the tensile strength of the side release buckle. However, increasing the cross sectional area of each locking bar simultaneously makes each locking bar relatively tougher, and the user shall have to employ much more effort to unlock the side release buckle. A side release buckle having tough locking bars is not suitable for children. Using material of high tensile strength can relatively increase the tensile strength of the side release buckle. However, the material change is not the concern of the present invention.

SUMMARY OF THE INVENTION

The present invention has been accomplished to provide a side release buckle, which eliminates the aforesaid problems.

It is therefore the main object of the present invention to provide a side release buckle, which provides a center lock that greatly improves the tensile strength of the buckle.

According to one aspect of the present invention, the side release buckle comprises a male buckle member, which comprises two locking bars and a center bar spaced between the locking bars, a female buckle member, which comprises a receiving open chamber for receiving the locking bars and the center bar and two side notches for securing the locking bars of the male buckle member to lock the male buckle member to the female buckle member, and a center lock, which comprises a hook portion protruded from the free end of the center bar of the male buckle member and a hook hole formed in the female buckle member for receiving the hook portion.

According to another aspect of the present invention, the locking bars of the male buckle member each have a wedge block, which has a bevel face for moving the center bar to disengage the hooked portion from the hook hole when the user squeezed the locking bars inwards to disengage the locking bars from the side notches of the female buckle member.

DETAILED DESCRIPTION OF THE PREFERRED EMBODIMENT

Figure 1:
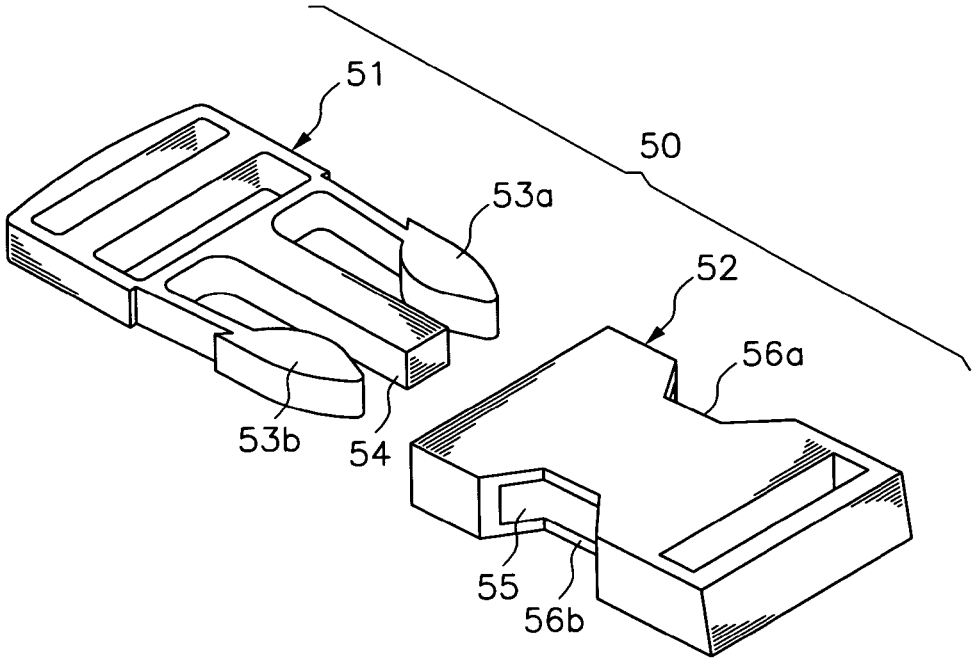
FIG. 1 (Prior Art)
FIG. 1 is an exploded view of a side release buckle according to the prior art.
Figure 2:
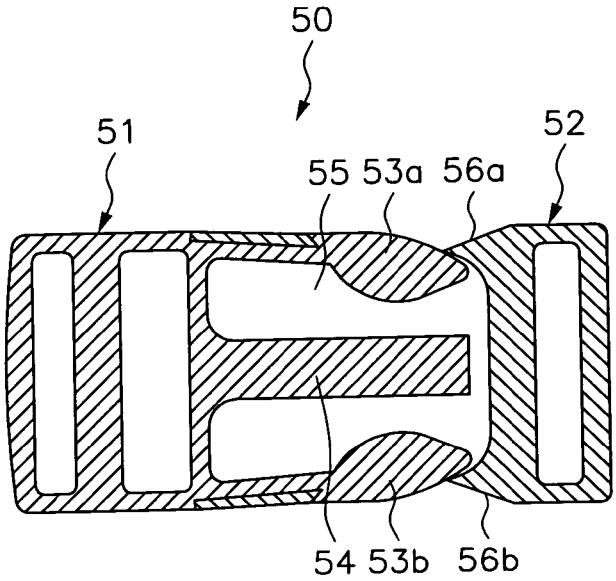
FIG. 2 (Prior Art)
FIG. 2 is a sectional view of the side release buckle according to the prior art, showing the male buckle member fastened to the female buckle member.
Figure 3:
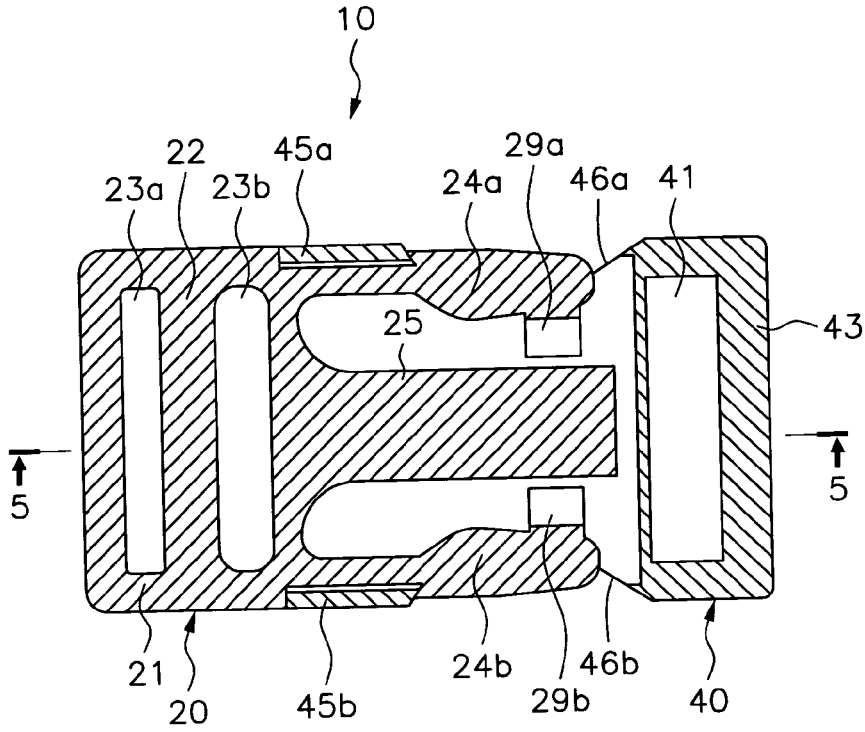
FIG. 3 is a sectional assembly view of a side release buckle according to the present invention.
Figure 4:
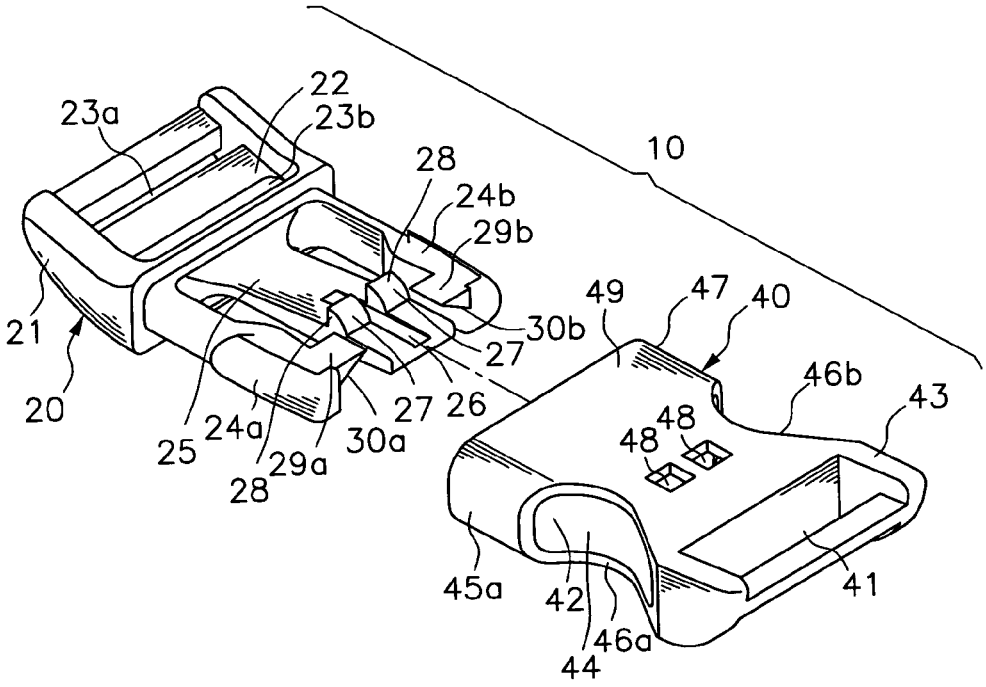
FIG. 4 is an exploded view of the side release buckle according to the present invention.
Figure 5:
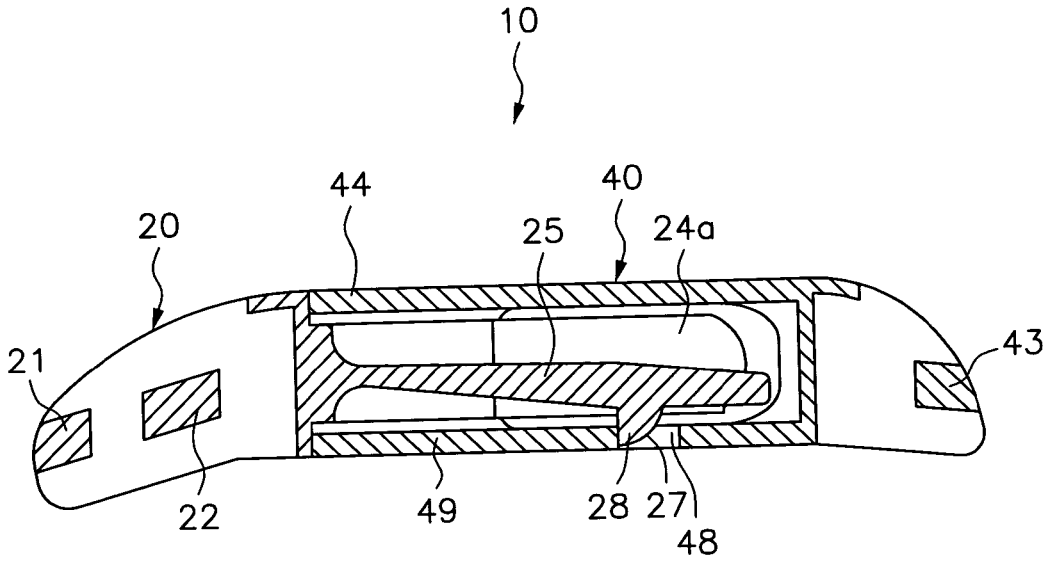
FIG. 5 is a sectional view taken in an enlarged scale along line 5—5 of FIG. 3.

Referring to FIGS. 3~5, a side release buckle 10 is shown comprised of a male buckle member 20 and a female buckle member 40. The male buckle member 20 comprises a mounting frame 21, a locating bar 22 transversely provided inside the mounting frame 21 and dividing the inside space of the mounting frame 21 into two belt holes 23*a*, 23*b* for the insertion of a belt member (not shown) to provide sufficient friction resistance that prevents sliding of the inserted belt member relative to the locating bar 22, two locking bars

24*a*,24*b* bilaterally perpendicularly extended from one side, namely, the front side of the mounting frame 21, and a center bar 25 perpendicularly extended from the front side of the mounting frame 21 on the middle between the locking bars 24*a*,24*b*. The center bar 25 reinforces the structural strength of the male buckle member 20 and prevents breaking of the locking bars 24*a*,24*b* due to an overpressure.

Figure 6:
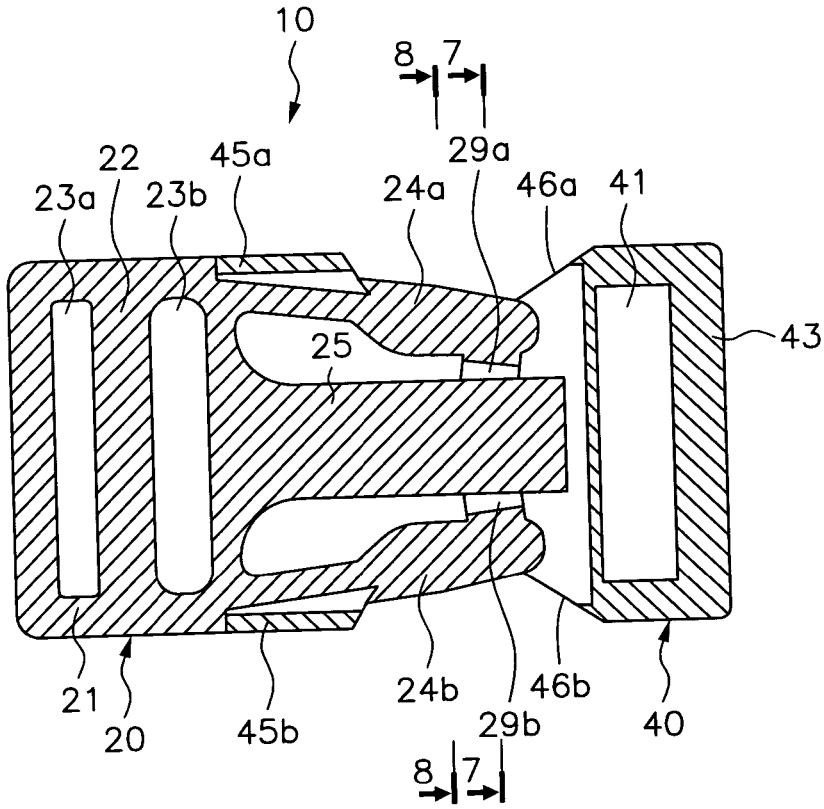
FIG. 6 is similar to FIG. 3 but showing the two locking bars of the male buckle member squeezed inwards and disengaged from the respective side notches of the female buckle member.

The female buckle member 40 comprises a mounting frame 43 and body 47. The mounting frame 43 defines a belt hole 41 for the insertion of a belt. The body 47 is formed integral with the front side of the mounting frame 43, having a bottom wall 49, a top wall 44, two sidewalls 45*a*,45*b*, a receiving open chamber 42 surrounded by the top and bottom walls 44,49 and the two sidewalls 45*a*,45*b* for receiving the male buckle member 20, and two side notches 46*a*,46*b* respectively formed in the sidewalls 45*a*,45*b* in communication with the receiving open chamber 42. After insertion of the male buckle member 20 into the receiving open chamber 42 of the female buckle member 40, the locking bars 24*a*,24*b* are forced by their resilient material property into engagement with the side notches 46*a*,46*b* to lock the male buckle member 20 to the female buckle member 40, as shown in FIG. 3. When squeezed the two locking bars 24*a*,24*b* inwards toward each other with the fingers, the locking bars 24*a*,24*b* are disengaged from the side notches 46*a*,46*b*, and therefore the male buckle member 20 is unlocked from the female buckle member 40, as shown in FIG. 6.

The above statement describes the basic structure of the side release buckle. The main technical feature of the present invention is the center lock design. As shown in FIGS. 4 and 5, the center bar 25 tilts in direction toward the bottom wall 49 of the body 47 of the female buckle member 40, having at least one, for example, two hooked portions 28 downwardly protruded from the bottom surface. The hooked portions 28 each have a smoothly curved front guide face 27. The female buckle member 40 has two hook holes 48 in the bottom wall 49 for receiving the hooked portions 28 of the center bar 25. When inserting the male buckle member 20 in the receiving open chamber 42 of the female buckle member 40, the smoothly curved front guide face 27 guides the respective hooked portion 28 forwards along the inside surface of the bottom wall 49 into the respective hook hole 48. When the hooked portions 28 of the center bar 25 are engaged into the hook holes 48, a click sound is produced, and the center lock (the hooked portions 28 and the hook holes 48 form a center lock) is locked. This center lock greatly enhances the tensile strength of the side release buckle 10. According to this embodiment, a longitudinal slot 26 is formed in the center bar 25 between the hooked portions 28. Alternatively, the center bar 25 can be made having only one hooked portion for hooking in one single hook hole in the bottom wall 49 of the body 47 of the female buckle member 40.

Figure 7:
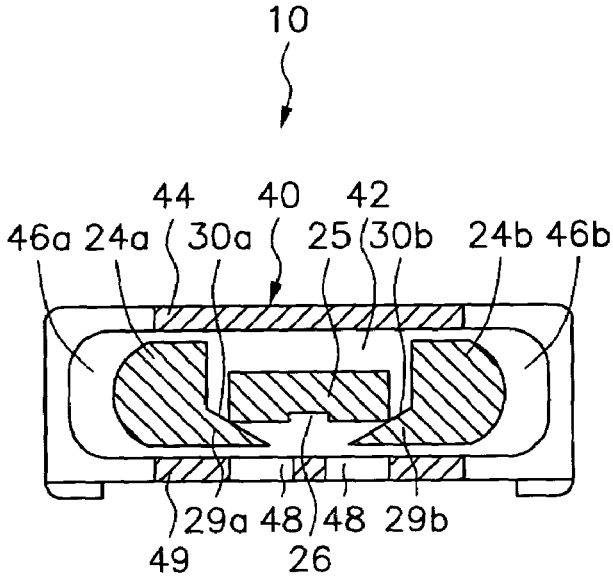
FIG. 7 is a sectional view taken along line 7—7 of FIG. 6, showing the wedge blocks moved against the bottom surface of the center bar.
Figure 8:
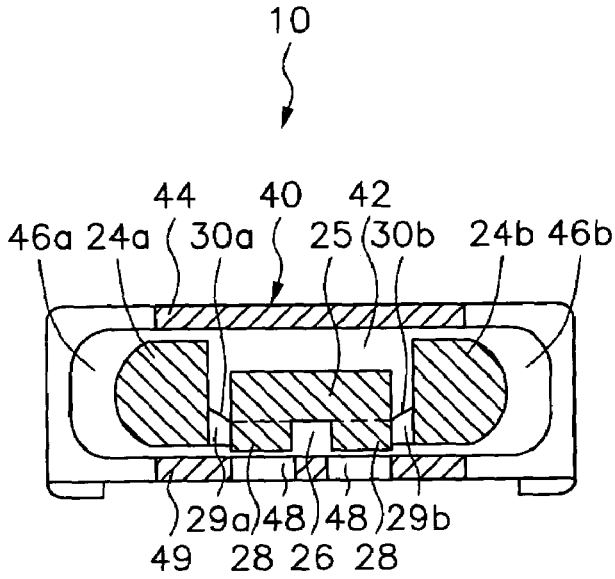
FIG. 8 is a sectional view taken along line 8—8 of FIG. 6, showing the center lock unlocked.

For easy unlocking of the center lock, the two locking bars 24*a*,24*b* are made having a respective wedge block 29*a* or 29*b* respectively protruded from the respective free end toward the center bar 25. Each wedge block 29*a* or 29*b* has a bevel face 30*a* or 30*b*. When squeezed the locking bars 24*a*,24*b* inwards toward each other to disengage the locking bars 24*a*,24*b* from the side notches 46*a*,46*b* (see FIG. 6), the bevel faces 30*a*,30*b* of the wedge blocks 29*a*,29*b* are transversely moved against the bottom surface of the free end of the center bar 25 to lift the free end of the center bar 25 (see FIG. 7), and therefore the hooked portions 28 are disengaged from the hook holes 48 to unlock the center lock (see FIG. 8). Therefore, it is quite simple to unlock the side release buckle 10, i.e., the added center lock does not complicate the unlocking procedure of the side release buckle 10.

According to the present invention, the mounting frames 21,43 of the buckle members 20,40 respectively tilt downwards. When the side release buckle 10 receives a pulling force, most components of force act downwards to enhance the engagement between the hooked portions 28 and the hook holes 48. This explains when the hooked portions 28 are provided at the bottom side of the center bar 25 and the hook holes 48 are formed in the bottom wall 49 of the body 47 of the female buckle member 40. However, if each buckle member of the side release buckle is made in a flat manner with the two distal ends on the same plane, the hooked portion(s) 28 can be selectively on the top or bottom side of the center bar 25, and the hook hole(s) 48 can be formed in the top wall 44 or bottom wall 49 of the body 47 of the female buckle member 40 subject to the position of the hooked portion(s) 28 at the center bar 25.

Although a particular embodiment of the invention has been described in detail for purposes of illustration, various modifications and enhancements may be made without departing from the spirit and scope of the invention.

What the invention claimed is:

1. A side release buckle comprising:

a male buckle member, said male buckle member comprising a mounting frame connectable to a first belt member, two locking bars bilaterally perpendicularly extended from a front side of the mounting frame of said male buckle member, and a center bar perpendicularly extended from the mounting frame of said male buckle member and spaced between said locking bars; and a female buckle member, said female buckle member comprising a mounting frame connectable to a second belt member, a body formed integral with a front side of the mounting frame of said female buckle member, said body comprising a top wall, a bottom wall, two sidewalls connected between said top wall and said bottom wall at two opposite lateral sides, a receiving opening chamber surrounded by said top wall, said bottom wall and said two sidewalls for receiving the locking bars and center bar of said male buckle member, and two side notches respectively formed in said two sidewalls for retaining said locking bars;

wherein said female buckle member has at least one hook hole formed in said bottom wall; said center bar of said male buckle member has at least one hooked portion protruded from a bottom surface thereof for engaging the at least one hook hole of said female buckle member to form with the at least one hook hole of said female buckle member a center lock; and wherein said locking bars of said male buckle member each have a free end terminating in a side wedge block facing said center bar, said side wedge block having a bevel face for lifting said center bar to disengage said at least one hooked portion from said at least one hook hole when the user squeezed said locking bars inwards to disengage said locking bars from the side notches of said female buckle member.

2. The side release buckle as claimed in claim 1, wherein said at least one hooked portion each has a smoothly curved front guide face for guiding the respective hooked portion to move along a top surface of the bottom wall of said female buckle member into the respective hook hole in the bottom wall of said female buckle member.

3. A side release buckle comprising:

a male buckle member, said male buckle member comprising a mounting frame connectable to a first belt member, two locking bars bilaterally perpendicularly extended from a front side of the mounting frame of said male buckle member, and a center bar perpendicularly extended from the mounting frame of said male buckle member and spaced between said locking bars; and a female buckle member, said female buckle member comprising a mounting frame connectable to a second belt member, a body formed integral with a front side of the mounting frame of said female buckle member, said body comprising a top wall, a bottom wail, two sidewalls connected between said top wall and said bottom wall at two opposite lateral sides, a receiving opening chamber surrounded by said top wall, said bottom wall and said two sidewalls for receiving the locking bars and center bar of said male buckle member, and twO side notches respectively formed in said two sidewalls for retaining said locking bars;

wherein said female buckle member has at least one hook hole formed in said top wall; said center bar of said male buckle member has at least one hooked portion protruded from a top surface thereof for engaging the at least one hook hole of said female buckle member to form with the at least one hook hole of said female buckle member a center lock; and wherein said locking bars of said male buckle member each have a free end terminating in a side wedge block facing said center bar, said side wedge block having a bevel face for lowering said center bar to disengage said at least one hooked portion from said at least one hook hole when the user squeezed said locking bars inwards to disengage said locking bars from the side notches of said female buckle member.

4. The side release buckle as claimed in claim 3, wherein said at least one hooked portion each has a smoothly curved front guide face for guiding the respective hooked portion to move along a bottom surface of the top wall of said female buckle member into the respective hook hole in the top wall of said female buckle member.

* * * * *